US012409999B2

(12) United States Patent
Williams

(10) Patent No.: US 12,409,999 B2
(45) Date of Patent: Sep. 9, 2025

(54) CONTAINER FOR TRANSPORTING TEMPERATURE-CONTROLLED ITEMS

(71) Applicant: Graham Williams, Portland, OR (US)

(72) Inventor: Graham Williams, Portland, OR (US)

(73) Assignee: CiloGear, Portland, OR (US)

( * ) Notice: Subject to any disclaimer, the term of this patent is extended or adjusted under 35 U.S.C. 154(b) by 0 days.

(21) Appl. No.: 17/486,283

(22) Filed: Sep. 27, 2021

(65) Prior Publication Data

US 2022/0119186 A1 Apr. 21, 2022

Related U.S. Application Data

(60) Provisional application No. 63/093,563, filed on Oct. 19, 2020.

(51) Int. Cl.

| | |
|---|---|
| ***B65D 65/40*** | (2006.01) |
| ***B65D 25/28*** | (2006.01) |
| ***B65D 77/04*** | (2006.01) |
| ***B65D 81/38*** | (2006.01) |

(52) U.S. Cl.

CPC ..... *B65D 81/3862* (2013.01); *B65D 25/2873* (2013.01); *B65D 65/40* (2013.01); *B65D 77/0413* (2013.01); *B65D 81/3823* (2013.01)

(58) Field of Classification Search

CPC ..... B65D 77/0413; B65D 81/3862; B65D 5/2047; B65D 5/18; B65D 31/005; B32B 5/024

See application file for complete search history.

(56) References Cited

U.S. PATENT DOCUMENTS

| | | | | |
|---|---|---|---|---|
| 1,480,083 | A * | 1/1924 | Labombarde | B65D 5/18 229/126 |
| 5,201,868 | A * | 4/1993 | Johnson | B65D 5/566 229/930 |
| 5,638,978 | A * | 6/1997 | Cadiente | B65D 5/563 229/199 |
| 2006/0280924 | A1* | 12/2006 | Morin | D01F 6/46 428/292.1 |
| 2012/0071054 | A1* | 3/2012 | Nair | B32B 27/32 442/187 |

FOREIGN PATENT DOCUMENTS

| | | | | |
|---|---|---|---|---|
| GB | 2563732 | A * | 12/2018 | B65D 5/46 |
| GB | 2571547 | A * | 9/2019 | B32B 5/024 |
| WO | WO-9932374 | A1 * | 7/1999 | B65D 81/3858 |

* cited by examiner

*Primary Examiner* — Mollie Impink

(74) *Attorney, Agent, or Firm* — Chernoff, Vilhauer, McClung & Stenzel LLP

(57) ABSTRACT

A container includes an outer container including four sides and a bottom constructed from a self-reinforced composite material and/or self-reinforced polymer material. An inner container including a vacuum packed insulative material. The outer container comprising a single sheet of the self-reinforced composite material and/or self-reinforced polymer material with a plurality of tabs that overlap with a plurality of sides of the container. The outer container does not include any interior overlapping seams.

7 Claims, 17 Drawing Sheets

CONTAINER FOR TRANSPORTING TEMPERATURE-CONTROLLED ITEMS

CROSS-REFERENCE TO RELATED APPLICATIONS

This application claims the benefit of U.S. Provisional Patent Application Ser. No. 63/093,563 filed Oct. 19, 2020.

BACKGROUND OF THE INVENTION

The shipment of temperature sensitive goods may be accomplished by placing the temperature sensitive goods, such as blood, plasma, medical supplies, food products, or other cold chain materials, in a container. The container may then be placed within a temperature-controlled case that includes a corresponding built in power source to provide active refrigeration and temperature control for the temperature sensitive goods maintained therein. While functional, the resulting container system is bulky and excessively heavy to be carried around, such as by a medic in a battlefield.

The shipment of temperature sensitive goods is extremely difficult when the shipping container itself is not independently temperature controlled. If it is desirable to only maintain the temperature sensitive goods at a nominally cooled temperature, relative to the ambient temperature, then a common practice is to pack ice or dry ice around the temperature sensitive goods. When using ice, the container hopefully maintains the temperature sufficiently cool until the goods are desired to be used. Unfortunately, the goods tend to significantly increase in temperature as the ice melts, especially in warm environments, likely spoiling the goods. Also, different regions within the container tends to have substantially different temperatures, further complicating the transportation of temperature sensitive goods. Moreover, the temperature of the goods during the melting of the ice tends to vary, likely in a range in excess of that which is desired to maintain the integrity of the goods, especially goods where the temperature needs to be maintained within a relatively narrow range to assure quality, although frozen is not desirable.

In other situations, it is desirable to ship the temperature sensitive goods at a temperature above the anticipated ambient temperature, such as in artic regions or during the winter. In this case, the temperature sensitive goods are placed into the container at a warm temperature relative to the ambient temperature. The goods are shipped to the destination with a hope that the shipping time is sufficiently short in duration before the temperature sensitive goods become too cold as the heat inside the container escapes.

The foregoing and other objectives, features, and advantages of the invention may be more readily understood upon consideration of the following detailed description of the invention, taken in conjunction with the accompanying drawings.

DETAILED DESCRIPTION OF PREFERRED EMBODIMENT

Figure 1:
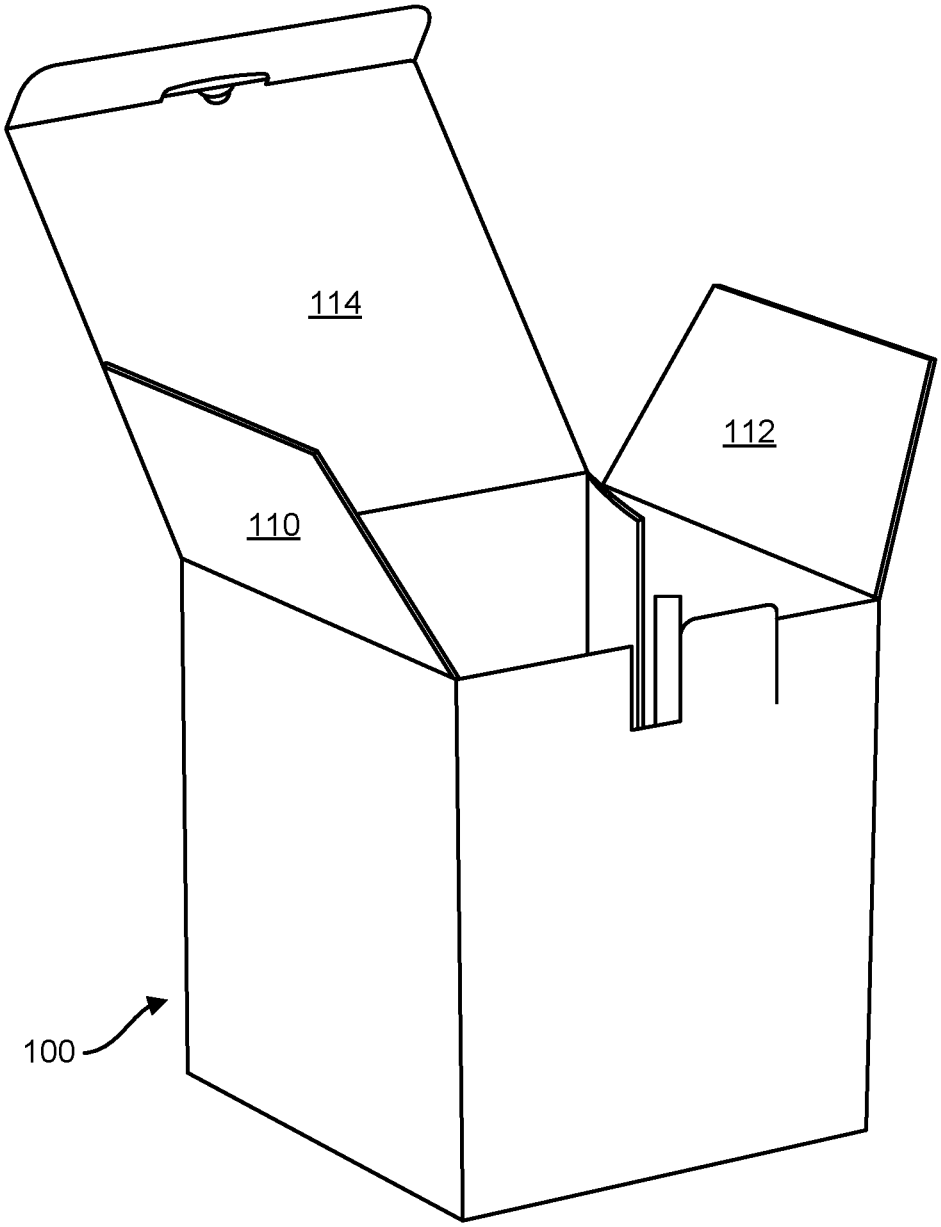
FIG. 1 illustrates a cardboard box.

Referring to FIG. 1, one manner of providing a thermal protection system for a temperature sensitive product includes a cardboard or a corrugated plastic box 100, that includes a set of upper flaps 110, 112, 114 that may be folded over to secure the top of the cardboard box 100.

Figure 2:
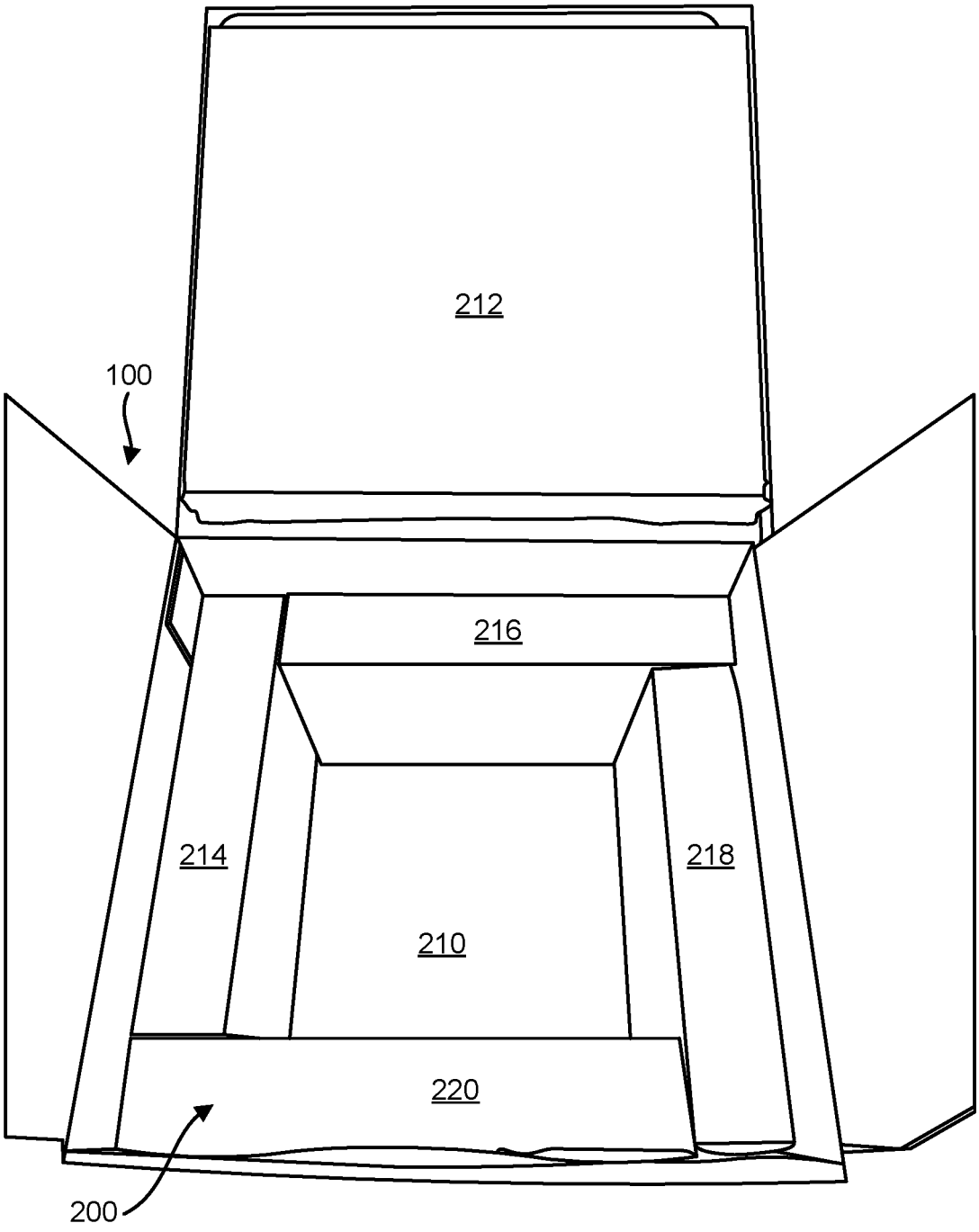
FIG. 2 illustrates a cardboard box with an insulated thermal chamber therein.

Referring to FIG. 2, the thermal protection system may include an insulated thermal chamber 200. The insulated thermal chamber 200 may include a plurality of insulated panels, namely a bottom panel 210, a top panel 212, a left panel 214, a forward panel 216, a right panel 218, and a back panel 220. In combination, the panels 210, 212, 214, 216, 218, 220, form a closed chamber. Each of the panels may be a vacuum insulated panel consisting of a cell foam core material to which a vacuum is applied surrounded by a gas tight outer film. Each of the panels and outer film may be encased within a protective sleeve to help protect the gas tight outer film. Other insulated materials may likewise be used, such as for example, Styrofoam, if desired.

Figure 3:
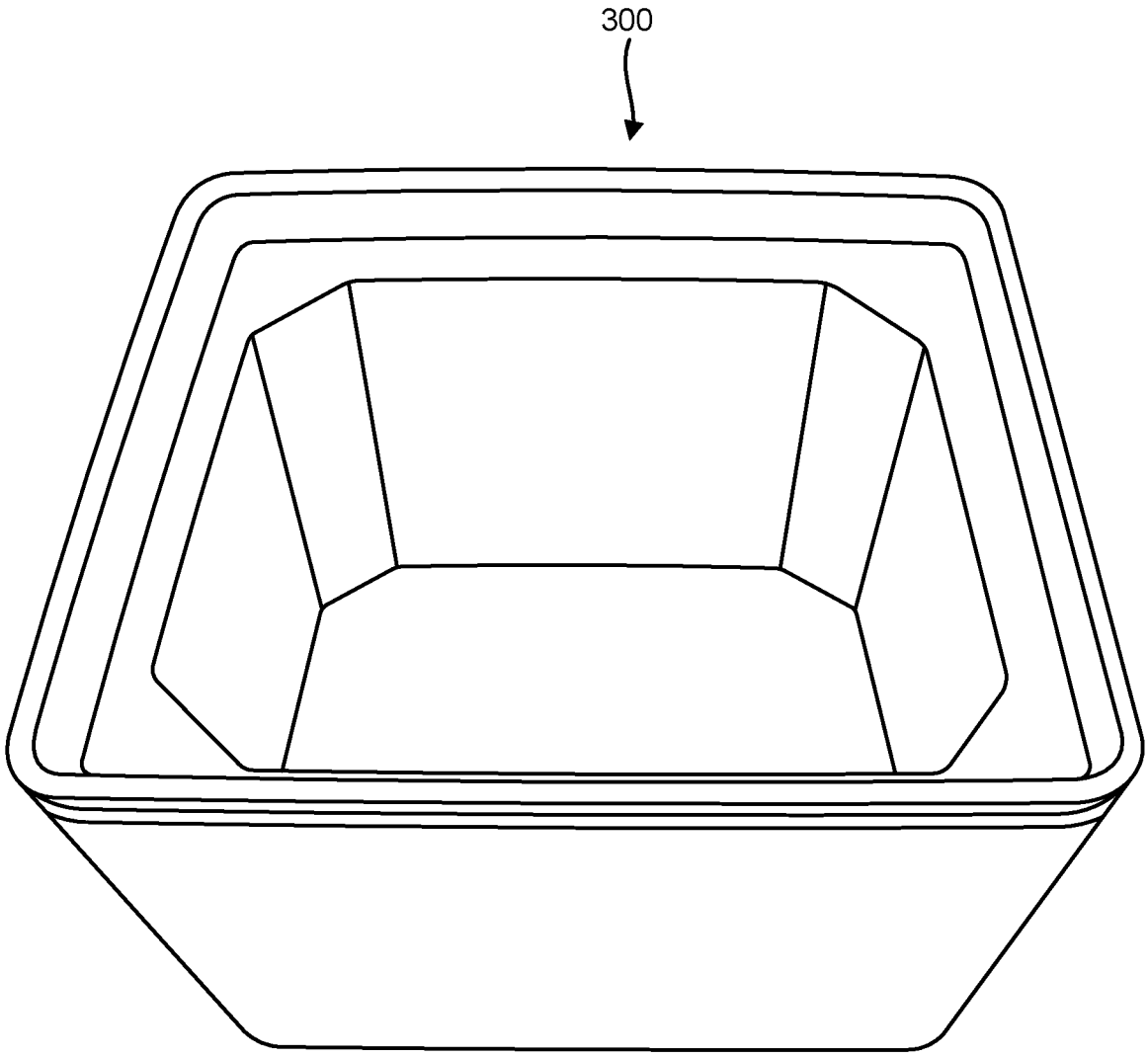
FIG. 3 illustrates a protective chamber.

Referring to FIG. 3, a protective chamber 300 may be sized suitable to be maintained within the insulated thermal chamber 200. The protective chamber 300 may also include a corresponding lid sized to fit on top of the protective chamber 300. The protective chamber may be molded from plastic, or any other suitable material.

Figure 4:
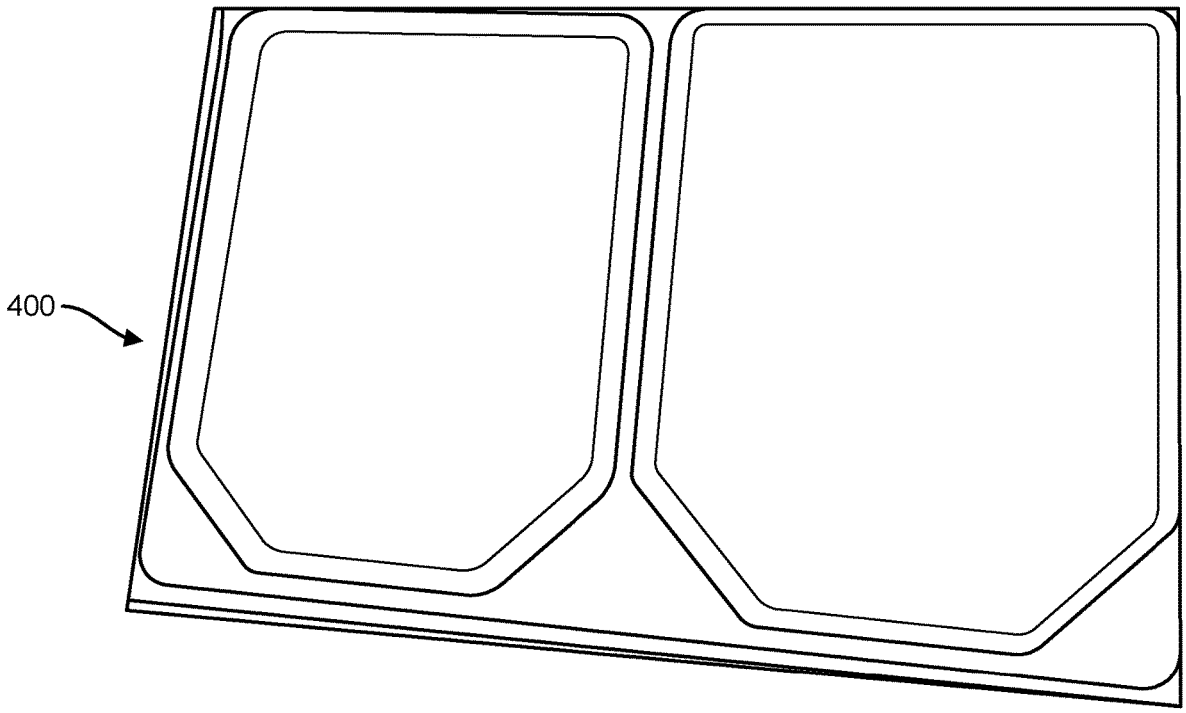
FIG. 4 illustrates a thermal isolation chamber panel.

Referring to FIG. 4, one or more thermal isolation chamber panels 400 may be included, if desired. The thermal isolation chamber panel 400 includes phase change material therein, where the latent heat of going from a solid to a liquid phase provides extended temperature control. For example, for warm weather conditioning (outside temperature above 39 degrees F.), the panel may be placed in a 5 degrees F. to −22 degrees F. freezer for 8 hours until the panel is frozen. Then the panel is removed from the freezer to warm up to an operating temperature of 34 degrees F. by letting it stand at a room temperature of 71 degrees for approximately 15 minutes. The panel will them maintain that temperature within 5 degrees for several hours. For example, for cold weather conditioning (outside temperature below 34 degrees F.), the panel may be placed in a 39 degrees F. to 46 degrees F. refrigerator for 4 to 8 hours.

The thermal isolation chamber panel 400 is placed within the protective chamber 300 which is placed within the insulated thermal chamber 200 which is placed within the cardboard box 100. Alternatively, the thermal isolation chamber panel 400 is placed within the insulated thermal chamber 200 which is placed within a hard plastic high density polyethylene case or a roto-molded polypropylene based case.

In the case of blood, vaccines, food, breast milk, metals, and/or other products for transportation, a cold chain process is employed. The blood cold chain (including or alternatively other products) is a systematic process for the safe storage and transportation of blood from its collection from the donor to its administration to a patient who requires transfusion. It is referred to as a 'cold chain' because blood, being a biological substance, must be kept cold in order to reduce bacterial contamination and to prolong its life. Whole blood is warm when collected but must be cooled down to 4° C. and kept at this temperature until the point of transfusion. The purpose of a transfusion is to provide blood components that improve the hematological status of the patient. Whole blood can be used to yield various blood components. Most blood banks are able to separate red cells and plasma components. Some are able to prepare other products, such as platelet concentrates and cryoprecipitate. These products are often referred to as "wet products". Other plasma products, generally referred to as plasma derivatives, can be extracted from plasma by a pharmaceutical process called plasma fractionation. All of these products have a specific benefit to the patient. However, in order for the blood component or plasma derivative to provide that benefit, it must be transfused in a viable state. Blood must be stored and transported in equipment that meets defined standards of performance, and by staff who correctly follow established procedures at all times.

One of the key aspects to such blood cold chain is the packing and transportation required to move blood components safely through the blood cold chain, and in particular, the packing for safely transporting the blood to the patient, which may be in a remote location, using a portable transportation box. By way of example, this may include a medic in a forward military location, a paramedic, and/or a fire fighter responding to a car wreck, who is carrying the blood in the portable transportation box for emergency usage. The blood should be maintained at a temperature range between 38 degrees F. to 40 degrees F., for 12 to 120 hours, for increased effectiveness.

In a harsh environment, the cardboard box 100 tends to get wet and soggy, substantially degrading its structural integrity. Also, the cardboard box 100 has a substantial likelihood of being damaged as a result of shipping. With a decreased structural integrity of the cardboard box 100, the insulated thermal chamber 200 tends to be prone to puncture. Upon being punctured, the insulated thermal chamber 200 loses its vacuum seal thus compromising its insulative characteristics. In the case of a hard plastic box made from high density polythene, it tends to be brittle with relatively low impact resistance, which again the insulated thermal chamber 200 tends to be prone to puncture. Roto-molded boxes tend to be strong but are excessively heavy and bulky.

With such boxes made from cardboard and high density polythene being unsuitable for hard environments to protect the integrity of the insulated thermal chamber 200, a different approach is desirable that provides sufficient impact resistance, relatively thin material suitable for being carried by a medic, provides sufficient puncture resistance, sufficiently flexible to absorb impact, strong enough to sufficiently resist compressive impacts, and sufficiently smooth so that the insulated thermal chamber 200 is not abraded, all of which provide protection to the insulated thermal chamber 200 to protect the blood therein in a cold chain environment.

Figure 5:
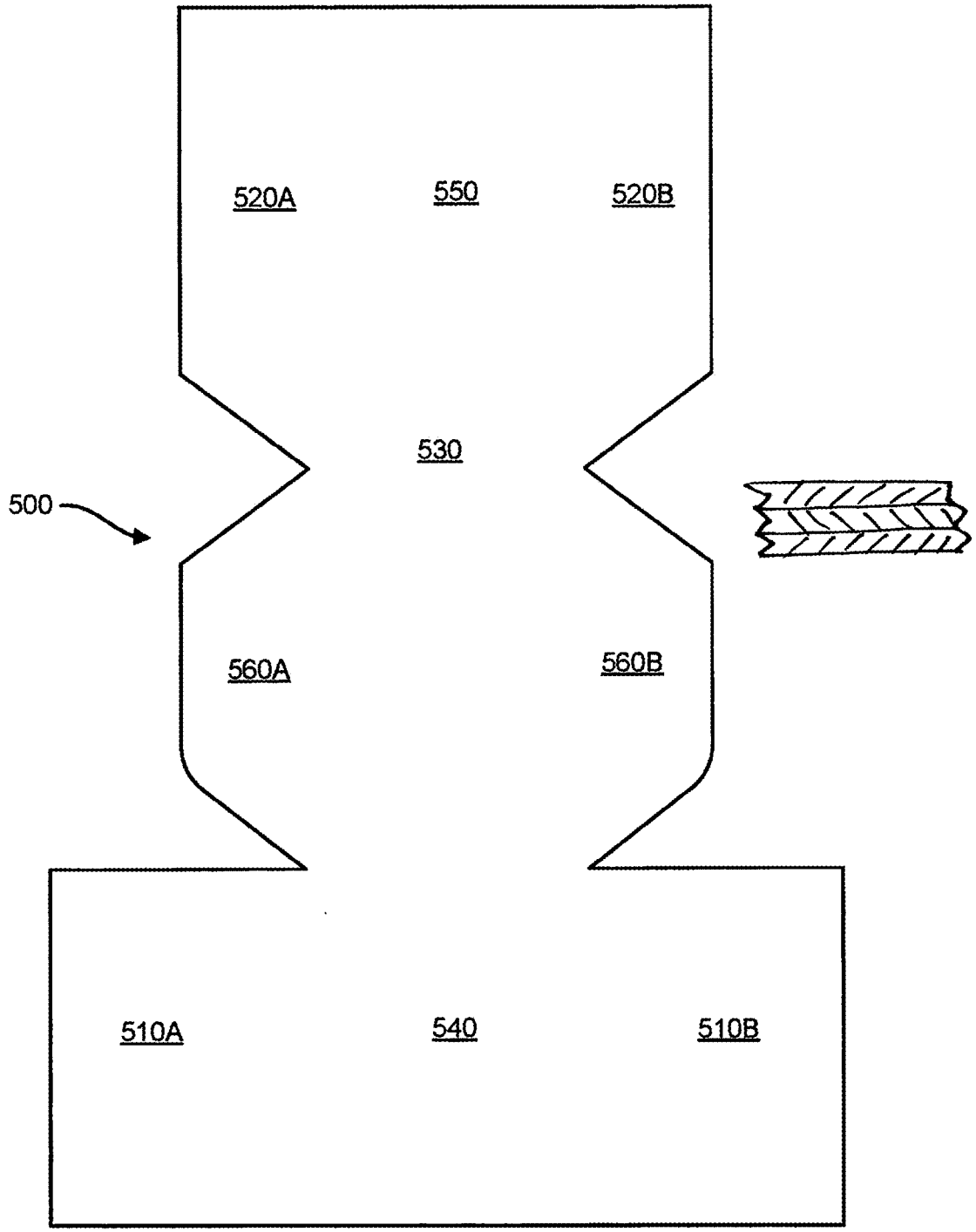
FIG. 5 illustrates a sheet.
Figure 6:
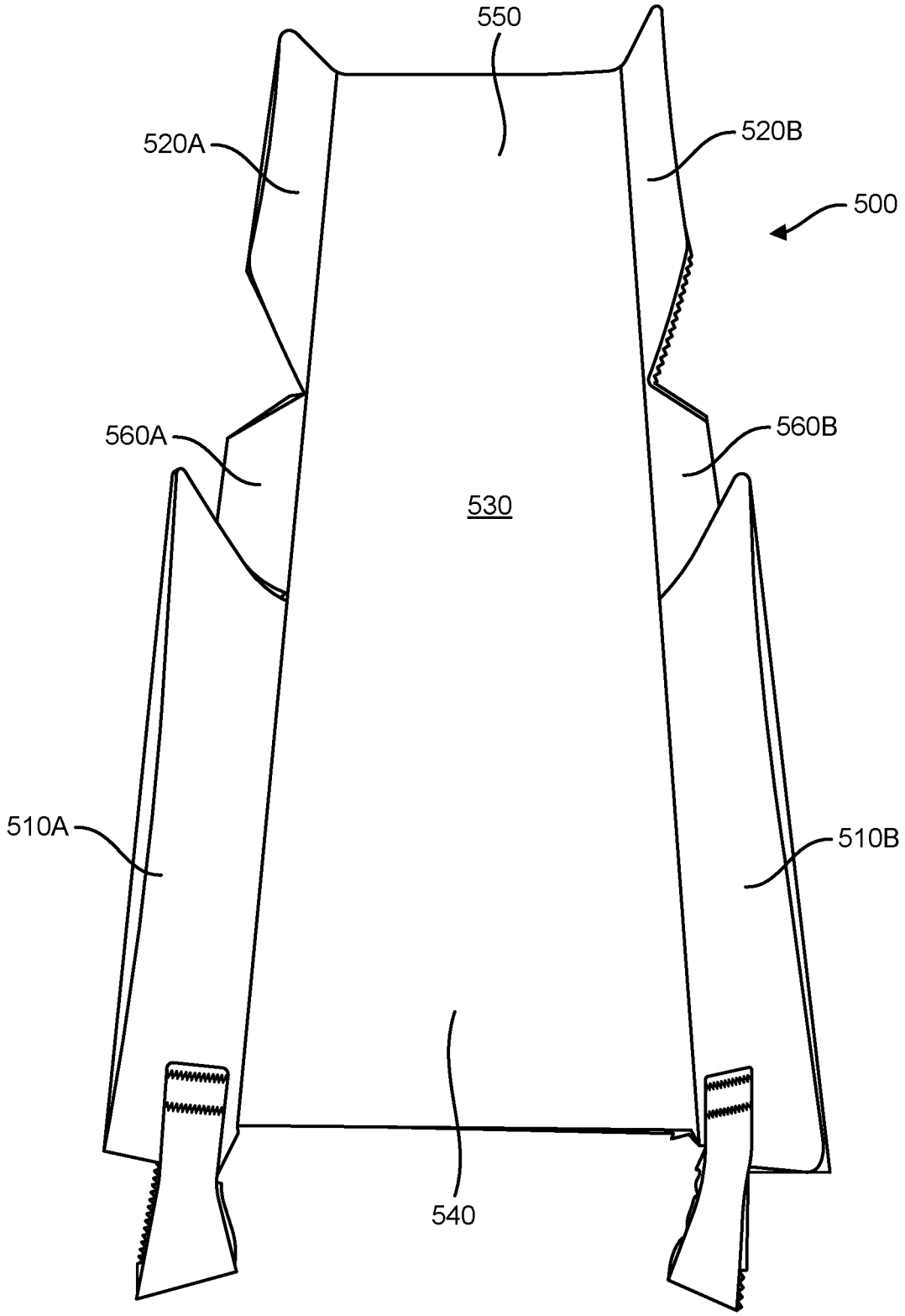
FIG. 6 illustrates the sheet partially folded.
Figure 7:
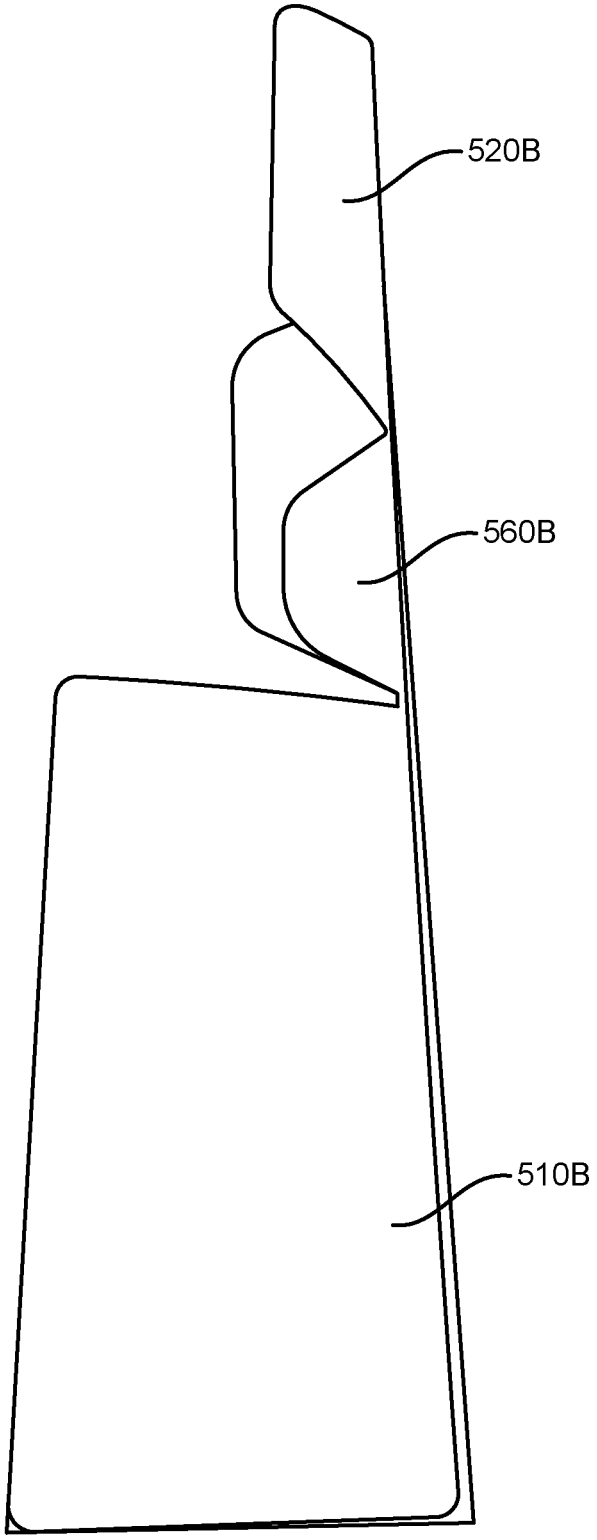
FIG. 7 illustrates the right side of the folded sheet.
Figure 8:
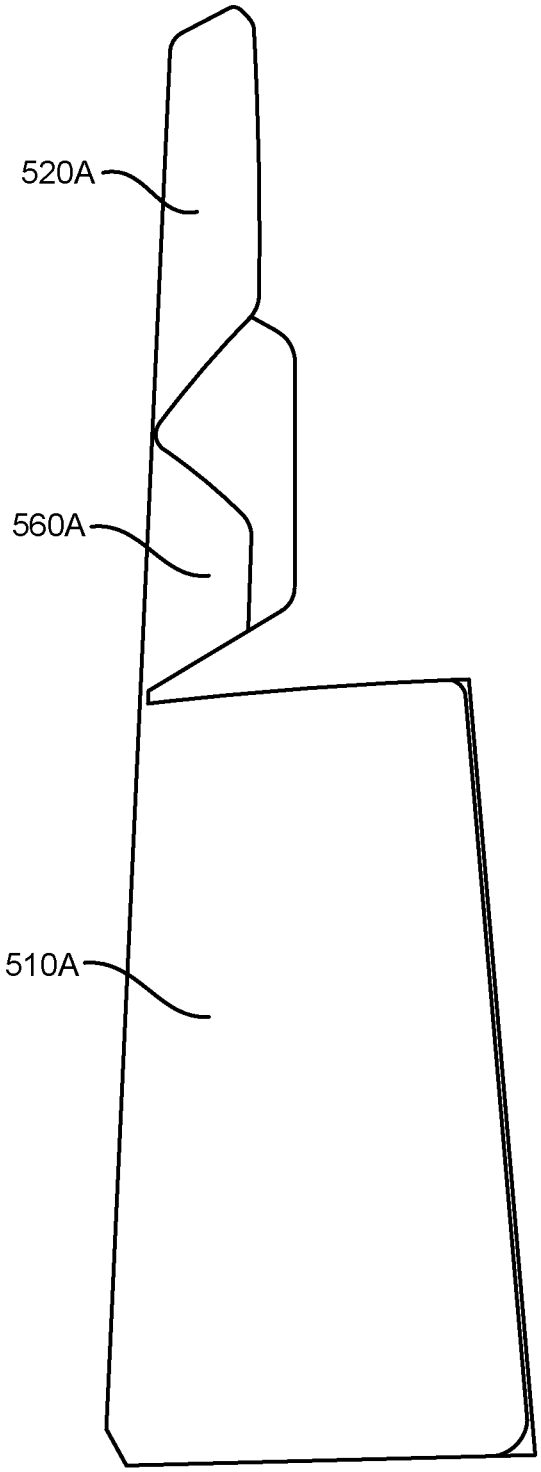
FIG. 8 illustrates the left side of the folded sheet.
Figure 9:
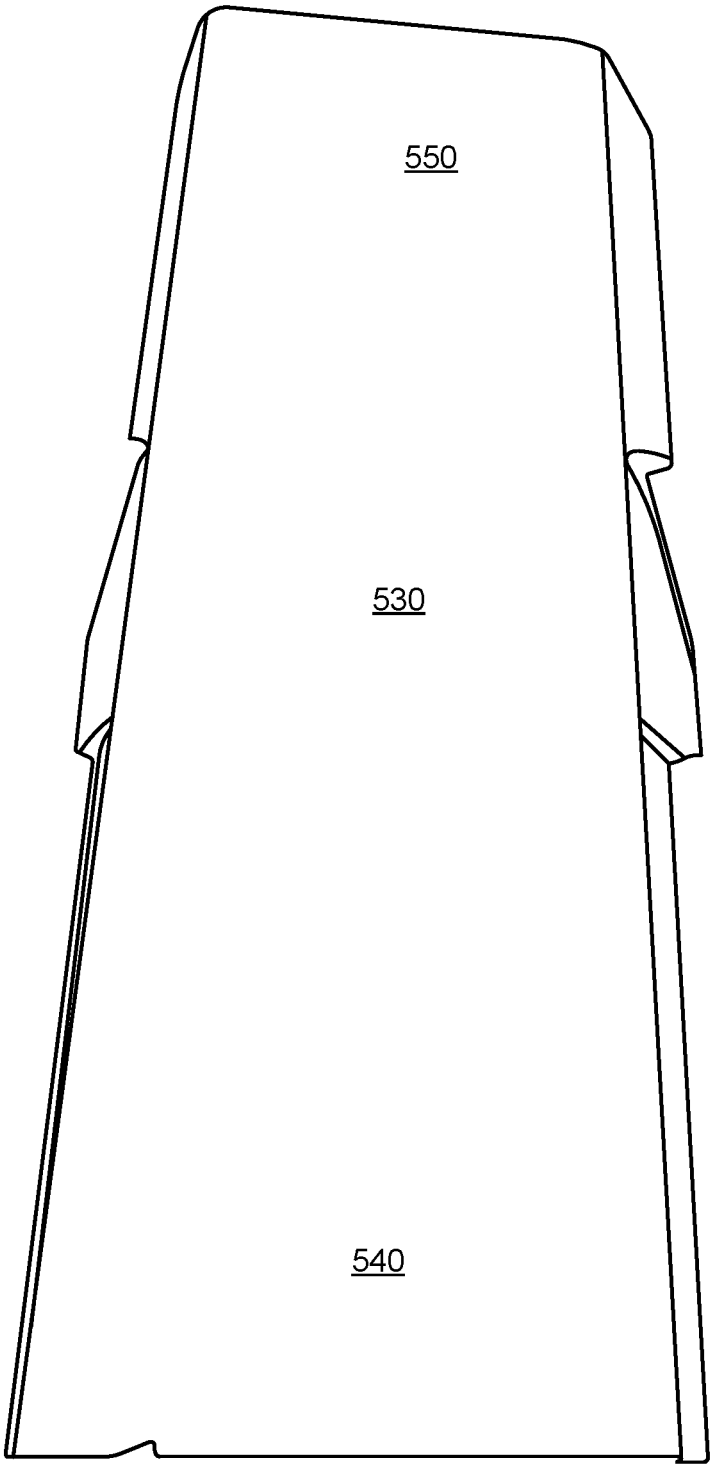
FIG. 9 illustrates the back side of the folded sheet.

Referring to FIG. 5, a preferred material includes a woven thermoplastic composite material, of a tape yarn construction, that provides impact resistance and stiffness while having a light weight. Some types of self-reinforced composites and/or polymers may use other types of construction, including for example, crystal extrusions, and traditional thread. The woven thermoplastic composite material preferably includes a multi-layer construction, with an outer layer preferably having a melt point at a lower temperature than a core material sandwiched therein. The multiple layers of the fabric are stacked together and heat and pressure is applied to form a substantially rigid, impact resistant, material. For example, a homogenous glue may be coated on a fiber or tape, and then the fire or tape is woven together, and then the layers of the fabric are composited through heat and pressure. Some types of the material, for example, may be constructed from a tape with a tensile modulus of 10 GPa or more, a shrinkage at 130 degrees C. of 6% or less, a sealing temperature of 120 degrees C. or more, and/or a denier of 900 or more. A single layer of the fabric preferably has a thickness of less than 1.0 mm. In general, self-reinforced polymeric materials (e.g., self-reinforced composite fabric) may be used, which may include one or more components, with the spatial alignment of the reinforcing phase in the matrix in 1D, 2D, or 3D.

By way of example, the woven thermoplastic composite material may start out a series of polypropylene (PP) films that form a tape yarn within a polymer matrix—for composite processing—before being woven into fabric. This is then pressed under heat and pressure to form a single piece approximately 0.005 inch (0.13 mm) that weighs just 0.02 lbs/sq.ft (0.11 kg/sq·m). Multiple layers are added depending on the desired thickness. The multi-layers are melted together. From there, the sheet can be formed into a variety of shapes using heat and pressure, depending on the mold. The end result contains no fragment-producing glass, unlike carbon fiber or various glass type structures, has high impact resistance and retains strength from around +180 degrees F. down to −40 degrees F.

By way of example, the self-reinforced composite materials may include a density (kg/m3) of greater than 800, and more preferably greater than 900. By way of example, the self-reinforced composite materials may include a tensile modulus (GPa) between 3 and 35, and more preferably between 3 and 30. By way of example, the self-reinforced composite materials may include a tensile strength (MPa) of greater than 100, and more preferably greater than 125, and less than 500, and more preferably less than 400. By way of example, the self-reinforced composite materials may include an edgewise notched Izod impact strength at 20 degrees C. (J/m) of greater than 100 and less than 6000, and more preferably greater than 1250 and less than 5000. Also, hybrid SRC composite materials together with carbon or ultra-high molecular weight polyethylene (e.g., 3 to 8 million amu) may be used. By way of example, he UHMWPE powder grade GUR 4120 (molecular weight of approximately 5.0×106 g/mol) may be used to produce an isotropic part of the multilayered sample. The powder may be heated up to 180° C. at a pressure of 25 MPa in a stainless-steel mold to produce 80×10×2 mm3 rectangular samples, with fibers having an average diameter of 15 μm (e.g., 10-20 μm) and a linear density of 220 Dtex (e.g., 150-300 Dtex).

Rather than a case constructed from brittle material that tends to puncture the vacuum packed insulative material, a case constructed from glass based carbon fiber material that tends to puncture the vacuum packed insulative material, or otherwise a structurally collapsible cardboard that tends to degrade making the vacuum packed insulative material readily subject to damage, preferably a case constructed from a self-reinforced polymeric material is used which provides sufficient impact resistance, relatively thin material suitable for being carried by a medic, provides sufficient puncture resistance, sufficiently flexible to absorb impact, strong enough to sufficiently resist compressive impacts, and sufficiently smooth so that the insulated thermal chamber is not abraded during usage.

Referring again to FIG. 5, a single flat sheet 500 of self-reinforced polymeric material may be cut to have a pattern that is suitable to form an enclosure from the single flat sheet of self-reinforced polymeric material. The sheet 500 may include a pair of first sides 510A, 510B, and a pair of second sides 520A, 520B. The sheet 500 may include a bottom surface 530, a front surface 540, and a rear surface 550. The sheet 500 may include a pair of bottom flaps 560A, 560B. Referring to FIG. 6, FIG. 7, FIG. 8, and FIG. 9, the single flat sheet may be folded, preferably within a press, to fold the flaps 510A, 510B, 520A, 520B, 560A, 560B with respect to the central region 530, 540, 550.

Figure 10:
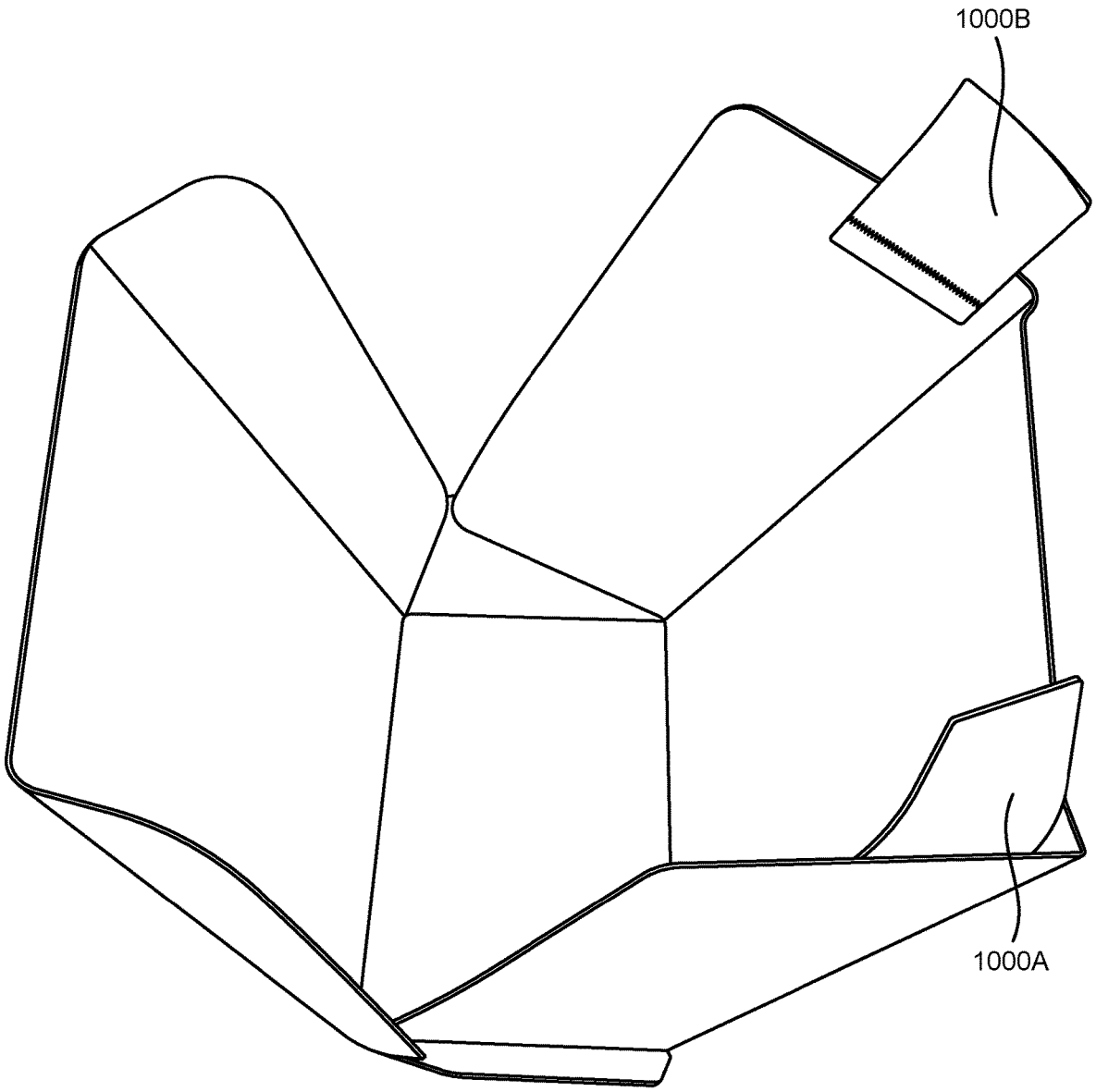
FIG. 10 illustrates the folded sheet being formed into a container.

Referring to FIG. 10, the sheet 500 may be folded so that the front surface 540 and the rear surface 550 are aligned with one another, and the first sides 510A, 510B and second sides 520A, 520B are overlapping with one another. The second sides 520A, 520B are preferably on the exterior of the first sides 510A, 510B, so that a smooth surface is maintained therein without seams. The bottom flaps 560A, 560B are preferably overlapping with the first sides 510A, 510B, so that a smooth surface is maintained therein without seams. The first sides 510A, 510B and the second sides 520A, 520B are adhered to one another, either with adhesive, or with sufficient heat and pressure to form a bond from the material itself. The bottom flaps 560A, 560A and the first sides 510A, 510B are adhered to one another, either with adhesive, or with sufficient heat and pressure to form a bond from the material itself. In this manner, the container is assembled without any interior seams that are likely to puncture the insulative material, and also provides sufficient protection for the insulative material from being punctured. The first sides 510A, 510B may further include hook and loop fabric 1000A, 1000B attached thereto to provide a handle or otherwise secure a lid thereon. Also, the container may include tabs for a locking, substantially waterproof, substantially airtight enclosure.

Figure 11:
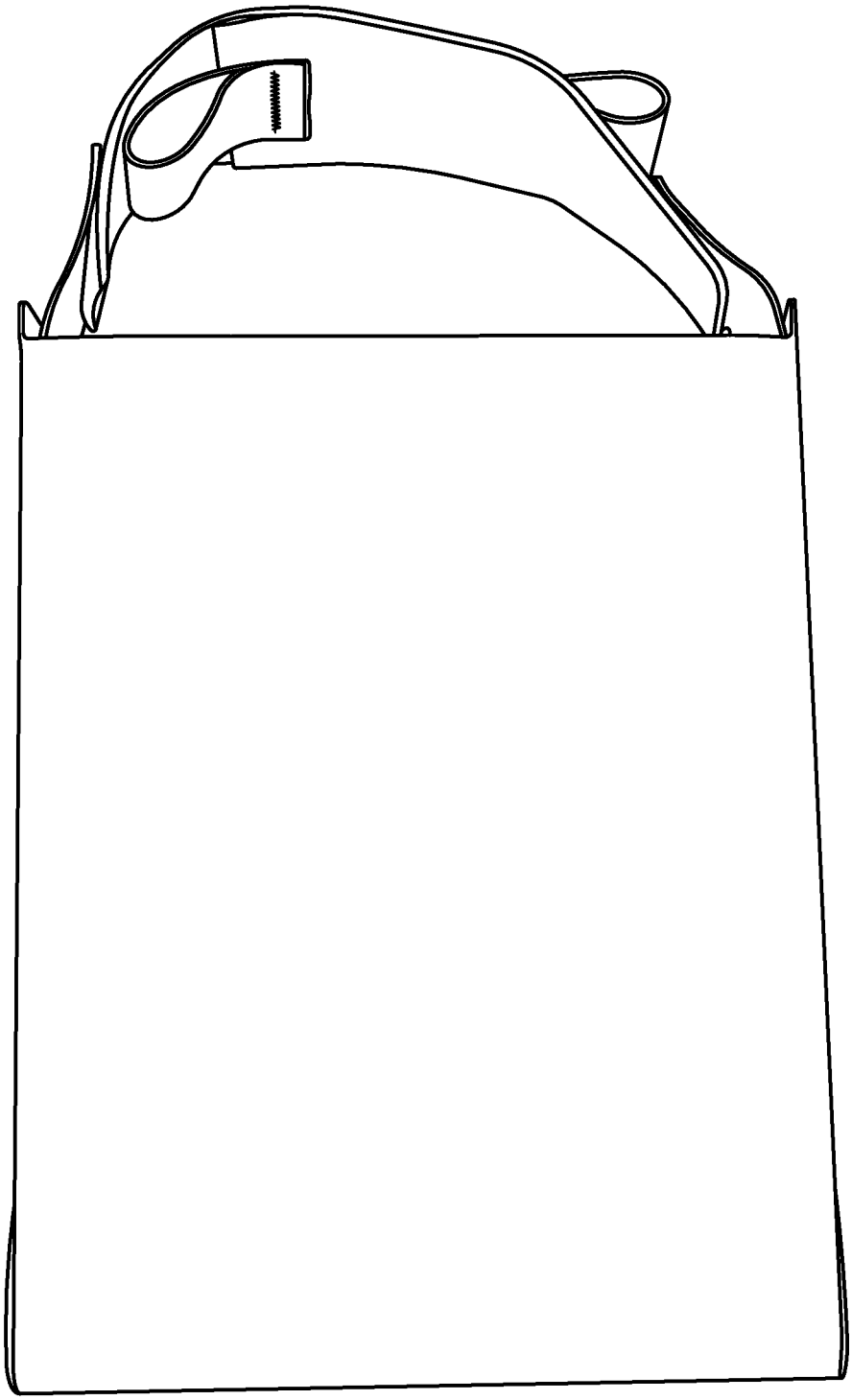
FIG. 11 illustrates a front side of the sheet folded into the container.
Figure 12:
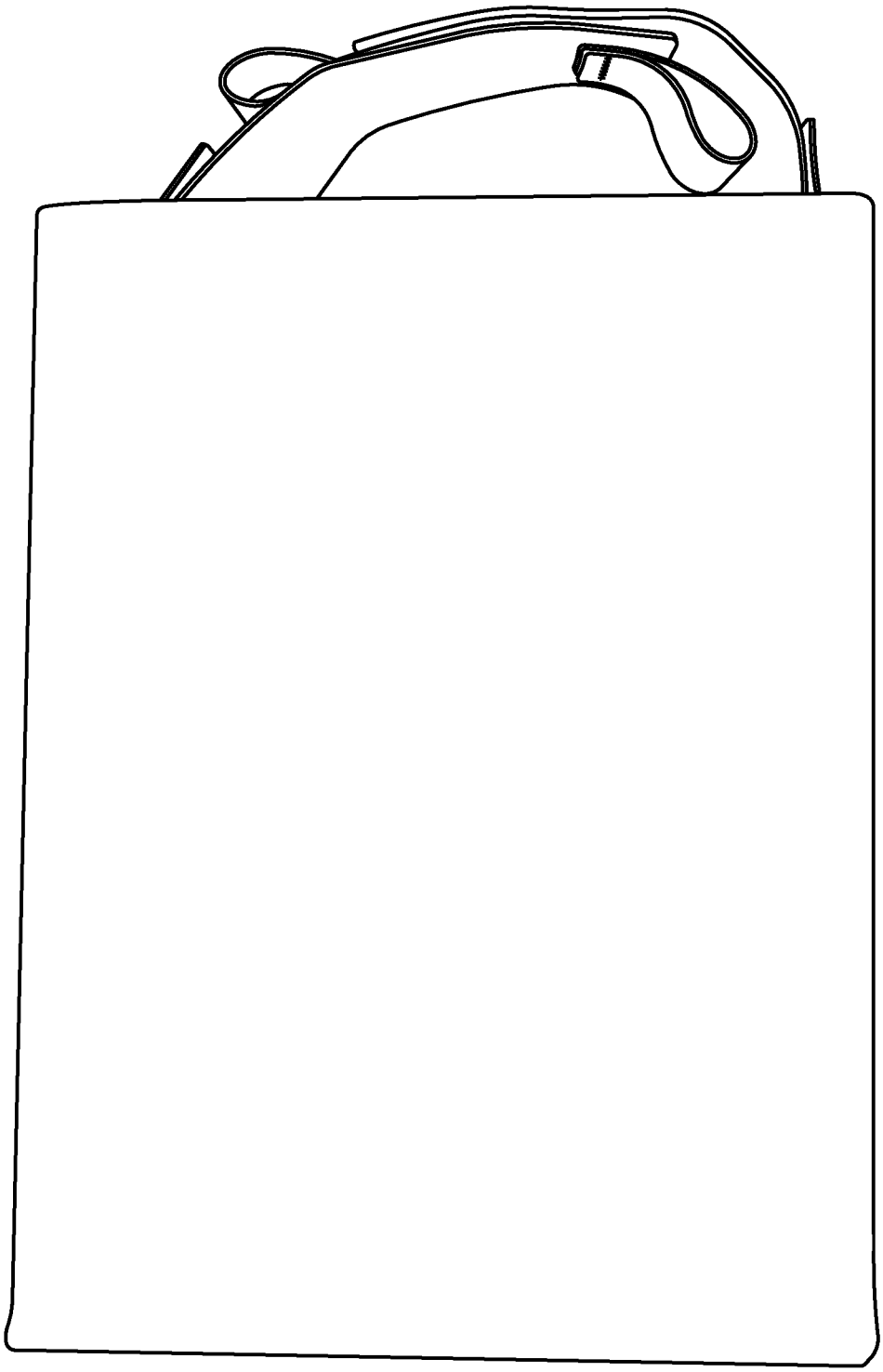
FIG. 12 illustrates a back side of the sheet folded into the container.
Figure 13:
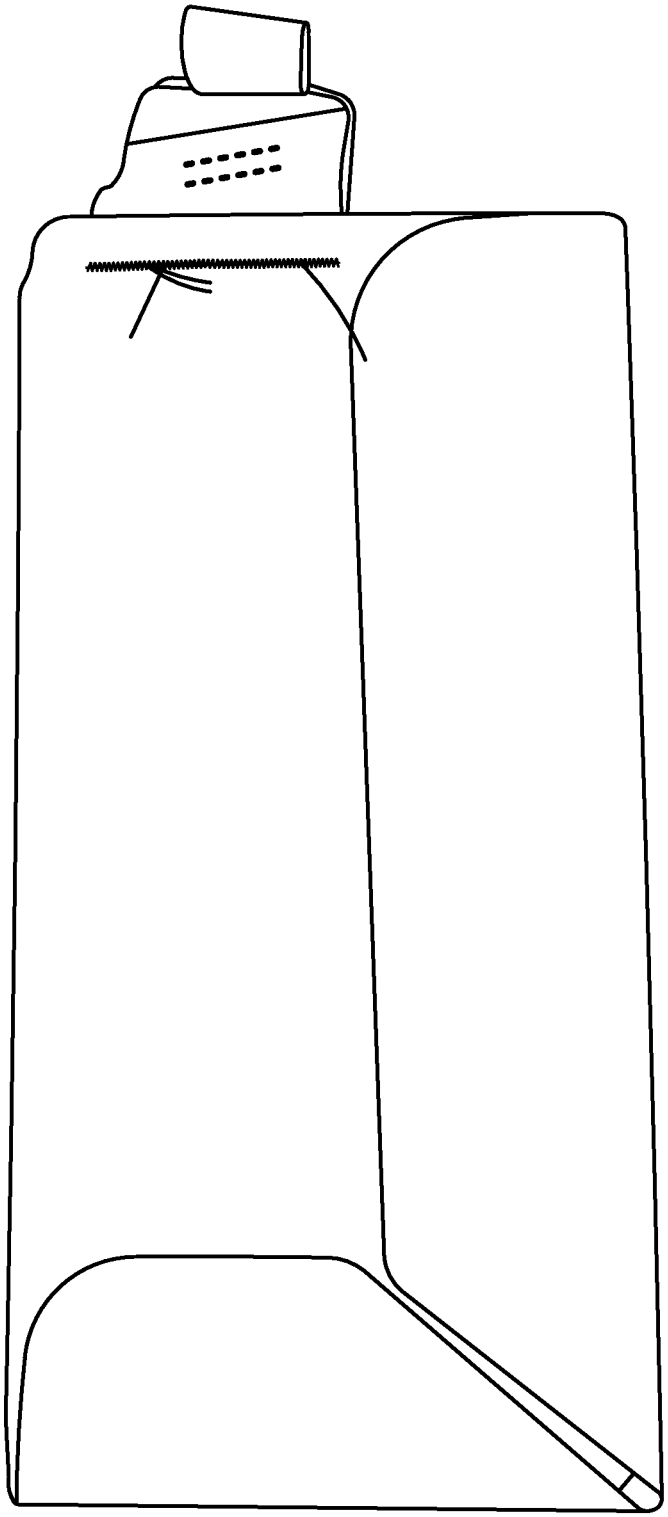
FIG. 13 illustrates a right side of the sheet folded into the container.
Figure 14:
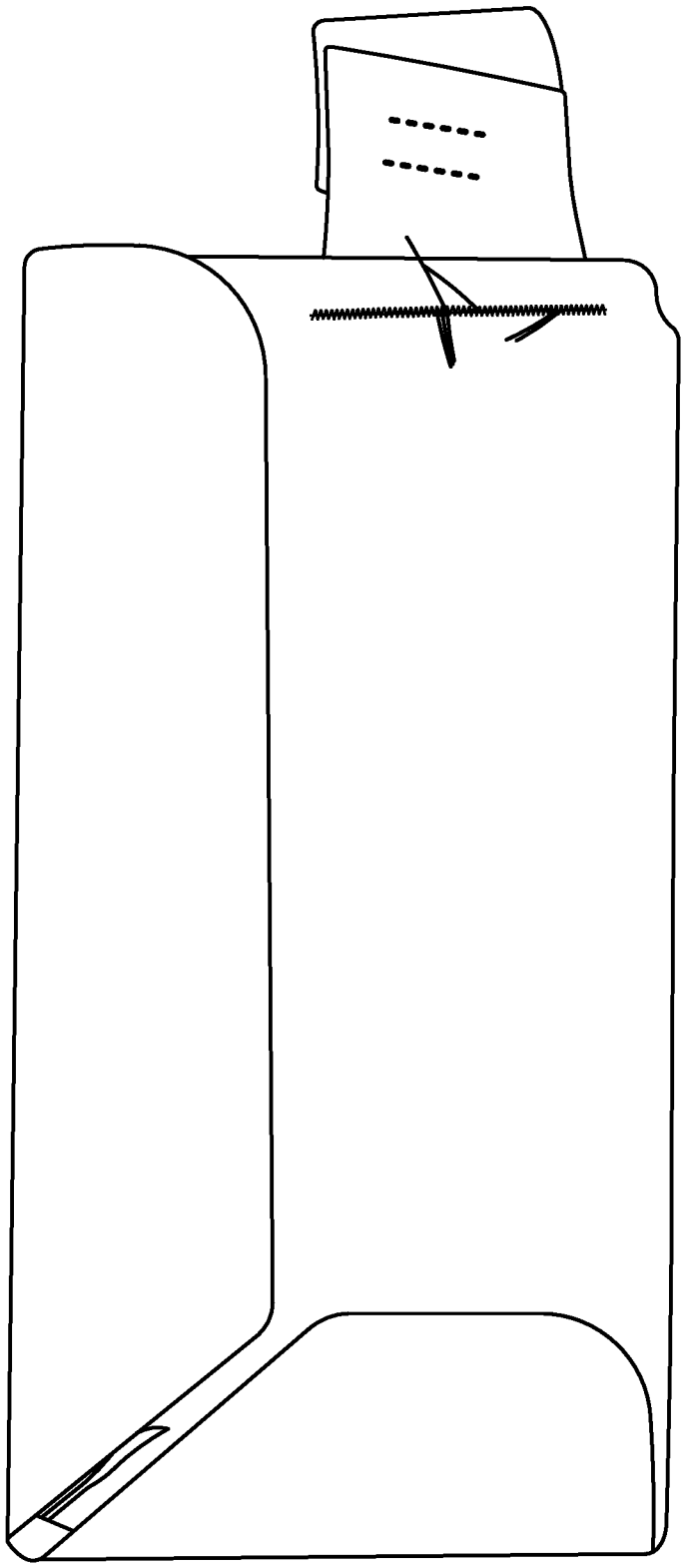
FIG. 14 illustrates a left side of the sheet folded into the container.
Figure 15:
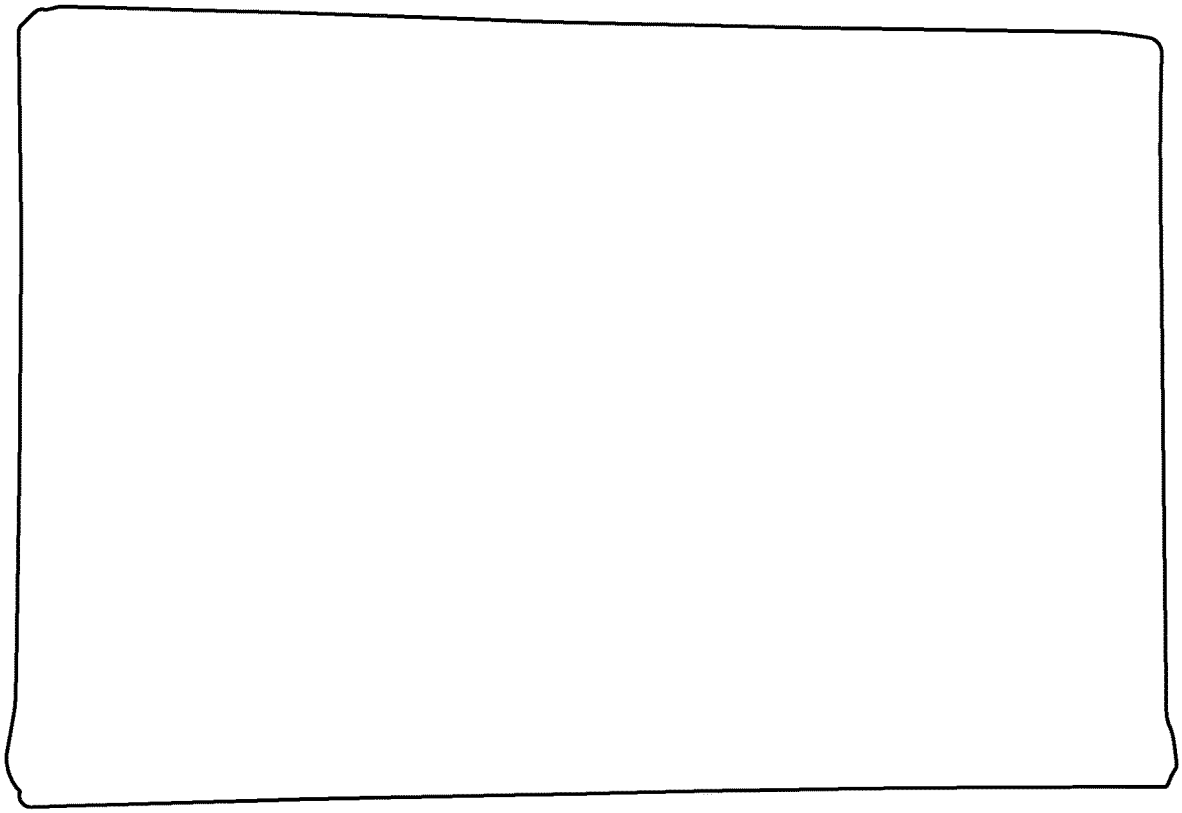
FIG. 15 illustrates a bottom side of the sheet folded into the container.
Figure 16:
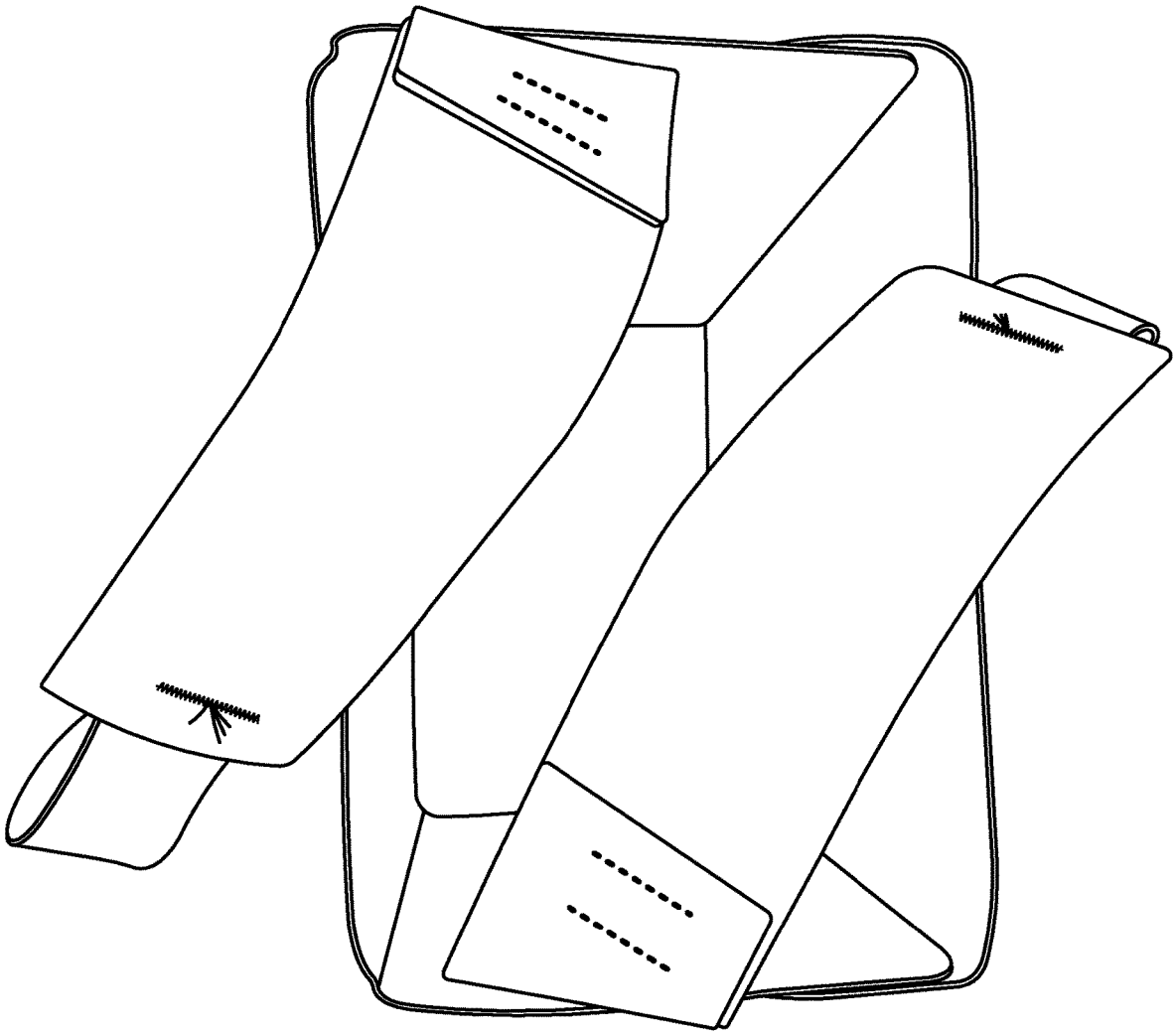
FIG. 16 illustrates a top side of the sheet folded into the container.

Referring to FIG. 11 (front view), FIG. 12 (back view), FIG. 13 (right side view), FIG. 14 (left side view), FIG. 15 (bottom view), and FIG. 16 (top view), is illustrated of the constructed container. The container may include a top flap, or otherwise a lid, if desired. The top flap and/or lid may be secured in any manner, such as a hook and loop strap, or a lock.

The overall system, that includes the thermal isolation chamber panel 400 placed within the protective chamber 300, if desired, placed within the insulated thermal chamber 200, placed within the self-reinforced polymeric material container may be used to ship blood test samples or other biologic materials, such as CV-19 samples, which reduces the likelihood of damage during transit.

The overall system, that includes the thermal isolation chamber panel 400 placed within the protective chamber 300, if desired, placed within the insulated thermal chamber 200, placed within the self-reinforced polymeric material container may be used to store breast milk shortly after pumping which reduces the likelihood of spoilage during the day.

Figure 17:
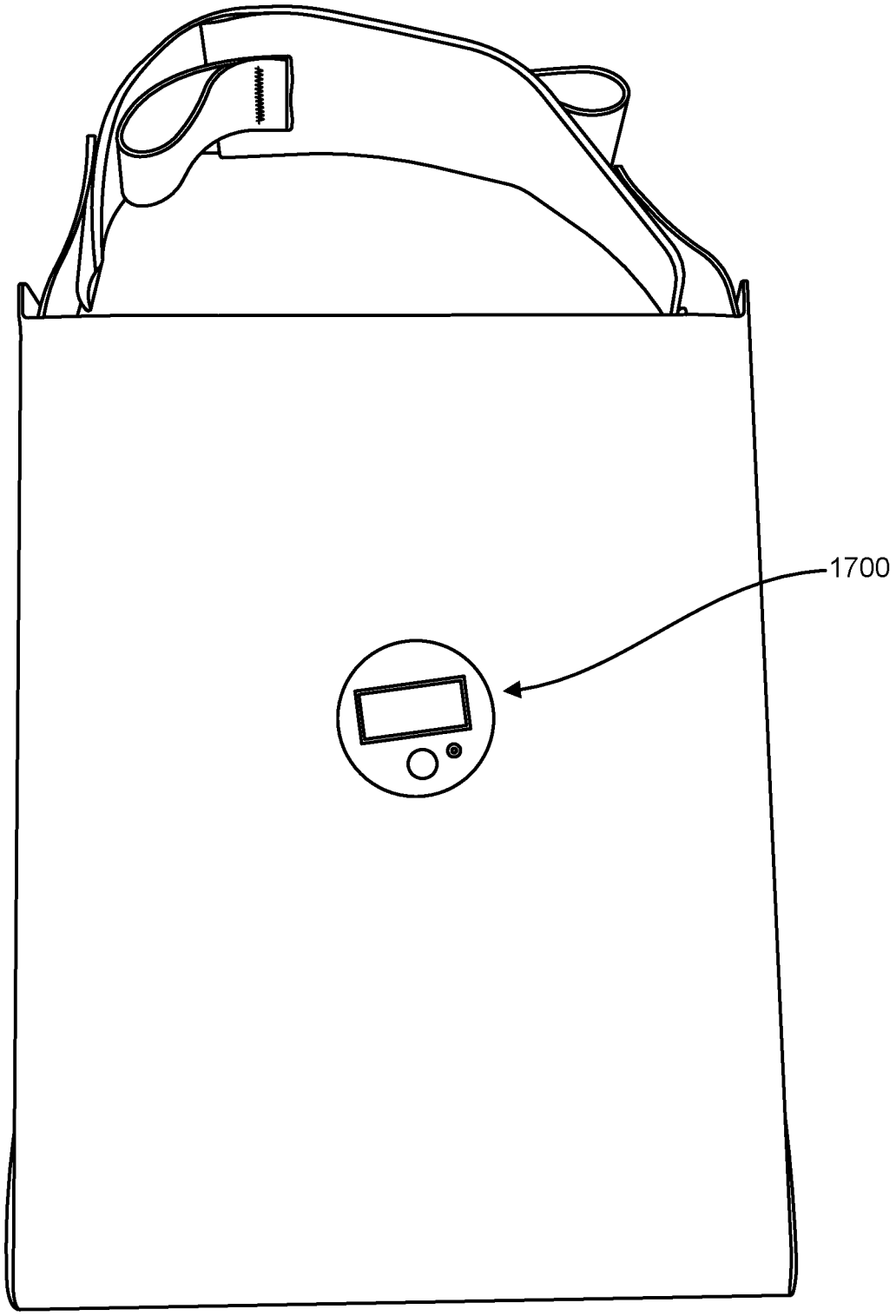
FIG. 17 illustrates the container with a temperature sensor.

Referring to FIG. 17, the overall system may further include an internal temperature sensor 1700 to track the internal temperature of the container over time. The temperature sensor 1700 may provide the current temperature and also provide the previous temperatures, so that the recipient can verify that the permitted range of temperatures has been maintained during transit. Other temperature sensors may likewise be used, as desired.

In another embodiment, the container is both sufficiently rugged and lightweight to be suitable for being delivered from a source location to a destination location using a flying vehicle, such as a drone with multiple rotating propellers. The container may be secured to the drone in a manner such that the container is not readily detachable, so that it will not be likely to fall during the flight from the source location to the destination location. The container should include a lid on the container, and in particular, the container should include a lid that is secured in some fashion, such as using a locking mechanism.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A blank, used to form a container comprising:

(a) said blank said used to form a first container constructed from a single sheet of material including four sides and a bottom constructed from only a self-reinforced composite material and/or self-reinforced polymer material, where said self-reinforced composite material and/or self-reinforced polymer material is of a tape yarn construction, where said self-reinforced composite material and/or self-reinforced polymer material of said tape yarn construction has a first layer of said tape yarn, where said self-reinforced composite material and/or self-reinforced polymer material of said tape yarn construction has a second layer of said tape yarn, where said self-reinforced composite material and/or self-reinforced polymer material of said tape yarn construction has a third layer of said tape yarn, where said first layer is self-reinforced based upon its matrix of composite material and/or polymer material without reference to said second layer or said third layer, where said second layer is self-reinforced based upon its matrix of composite material and/or polymer material without reference to said first layer or said third layer, where said third layer is based upon its matrix of composite material and/or self-reinforced polymer material without reference to said first layer or said second layer, where said second layer is sandwiched between said first layer and said third layer, where said first layer and third layer are outer layers of said self-reinforced composite material and/or self-reinforced polymer material, where said first layer has a first melt point, where said second layer has a second melt point, where said third layer has a third melt point, where said second layer has a greater melt point than said first layer, where said second layer has a greater melt point than said third layer, where the interior of said four sides does not include any discontinuities resulting from any overlapping seams of said first container, where the interior of said bottom does not include any discontinuities resulting from any overlapping seams of said first container, where said self-reinforced composite material is self-reinforced due to a mixture and/or layers of materials, where self-reinforced polymer material is self-reinforced due to a mixture and/or layers of materials, where overlapping seams of said first container are adhered together with a combination of heat and pressure sufficient to melt a corresponding pair of exterior layers to adhere the overlapping seams to one another;

(b) a second container including a vacuum packed insulative material, said second container included within said first container;

(c) said first container comprising said blank comprising said single sheet of said self-reinforced composite material and/or self-reinforced polymer material with a plurality of flaps that overlap with a plurality of sides of said container on an exterior surface of said plurality of sides, (d) wherein said blank comprises a front surface and a back surface folded up from a central panel, where said front surface includes a first pair of flaps folded from said front surface, where said back surface includes a second pair of flaps folded from said back surface, where a first respective pair of said first pair of flaps and said second pair of flaps form a first side of said first container, where a second respective pair of said first pair of flaps and said second pair of flaps form a second side of said first container.

2. The container of claim 1 wherein said self-reinforced composite material and/or said self-reinforced polymer material is a woven thermoplastic composite material having a tape yarn construction.

3. The container of claim 1 wherein said self-reinforced composite material and/or said self-reinforced polymer material has a crystal extrusion.

4. The container of claim 1 wherein said multi-layer construction results in a substantially rigid material.

5. The container of claim 1 wherein said self-reinforced composite material and/or said self-reinforced polymer material has a tensile modulus GPa between 3 and 35.

6. The container of claim 1 wherein said plurality of flaps that overlap with said plurality of sides of said container are secured together using adhesive.

7. The container of claim 1 wherein said plurality of flaps that overlap with said plurality of sides of said container are secured together using heat.

* * * * *